United States Patent [19]

Sarcia et al.

[11] Patent Number: 5,048,297

[45] Date of Patent: Sep. 17, 1991

[54] METHOD AND APPARATUS FOR CONTROLLING THE MOVEMENT OF A FREE, GAS-DRIVEN DISPLACER IN A COOLING ENGINE

[76] Inventors: Domenico S. Sarcia, 114 Sunset Rd., Carlisle, Mass. 01741; Richard J. Birch, 35 Elm St., Wellesley, Mass. 02181

[21] Appl. No.: 493,474

[22] Filed: Mar. 14, 1990

[51] Int. Cl.[5] ..... F02G 1/045; F25B 9/00

[52] U.S. Cl. ..... 60/520; 62/6

[58] Field of Search ..... 60/518, 520; 62/6

[56] References Cited

U.S. PATENT DOCUMENTS 3,991,586 11/1976 Accord ..... 62/6

4,397,155 8/1983 Davey ..... 60/520 X 4,792,346 12/1988 Sarcia ..... 60/520 X

*Primary Examiner*—Allen M. Ostrager

*Attorney, Agent, or Firm*—Richard J. Birch

[57] ABSTRACT

A method and apparatus for controlling the reciprocal movement of a free piston, gas-driven displacer in a cooling engine are disclosed. A bi-directional magnetic "detent" is established for the displacer at both the top dead center and bottom dead center portions of the cooling cycle. Each bi-directional magnetic "detent" provides a magnetic snubbing force to limit overshooting of the displacer in one direction and a magnetic retention force to hold the displacer from moving in the other direction until a pre-determined pressure differential is established across the displacer's drive piston. The magnetic "detents" are formed by means of a three pole double magnet with a single core or alternatively, by a two pole single magnet with a double core. The magnetic snubbing and retention forces can be made equal or unequal in magnitude either through the selection of permanent magnet(s) or core configuration(s) or by controlling the field strength of electro-magnets.

23 Claims, 6 Drawing Sheets

METHOD AND APPARATUS FOR CONTROLLING THE MOVEMENT OF A FREE, GAS-DRIVEN DISPLACER IN A COOLING ENGINE

BACKGROUND OF THE INVENTION

The present invention relates to cooling engines in general and, more particularly, to cooling engines having a free motion, gas-driven, piston actuated displacer.

Traditionally, free displacer, i.e., free piston cooling engines, work well thermodynamically, but lack sufficient reliability over a long period of time for them to be commercially successful against the currently available mechanical driven cooling engines. The problem with a free, gas-driven displacer is controlling the phase relationship between the position of the displacer and the pressure pulses of the working fluid at the top dead center and the bottom dead center of its cycle. In order to achieve high thermodynamic efficiency, the volumes at top dead center (TDC) and bottom dead center (BDC) should approach zero. With free displacer machines, this objective is very difficult to achieve without collisions taking place between the displacer and cylinder containing the displacer.

U.S. Pat. No. 4,792,346, issued Dec. 20, 1988, for "Method and Apparatus for Snubbing the Movement of a Free, Gas-Driven Displacer in a Cooling Engine" discloses a method for snubbing displacer movement that utilizes a magnetic repulsion force between the displacer and each end of the cylinder containing the displacer. Two stationary magnets are placed at the ends of the displacer containing cylinder and the displacer itself has two movable magnets attached to the ends of the displacer in such a manner that they act as magnetic springs, i.e., the like magnetic poles of the stationary and movable magnets at one end face each other and, similarly, the like magnetic poles of the stationary and movable magnets at the other end of the displacer and cylinder face each other.

As the displacer approaches one end of the cylinder, the repulsion force of the magnetic force of the magnetic spring stores the kinetic energy of the displacer and prevents a collision from taking place. When the displacer is allowed to move in the other direction, the stored energy is converted back into kinetic energy in the opposite direction. Thus, the displacer is essentially suspended between the two magnetic repulsion forces which prevent collisions between the displacer and the ends of the displacer containing cylinder. The disclosure of U.S. Pat. No. 4,792,346 is incorporated herein by reference.

U.S. Pat. No. 3,991,586, issued Nov. 16, 1976, for "Solenoid Controlled Cold Head for a Cryogenic Cooler" discloses a closed cycle cryogenic cooler, utilizing two solenoids that selectively drive or selectively brake the regenerator-displacer. The physical position of the regenerator-displacer is used to control the actuation of the solenoids. The disclosure of U.S. Pat. No. 3,991,586 is incorporated herein by reference.

In order to achieve maximum cooling efficiency, the pressure/volume diagram ideally should be a perfect rectangle. Stated in terms of the displacer movement, the displacer should remain stationary while the pressure changes occur and commence its movement from TDC when a predetermined pressure is reached and should move to BDC without significantly overshooting the BDC position. Similarly, the displacer should be retained at the BDC position until a predetermined pressure differential is reached and then the displacer should move to TDC without significantly overshooting the TDC position.

It is accordingly a general object of the present invention to provide both a method and apparatus for controlling the phase relationship between the movement of a free piston, gas-driven displacer and the pressure pulses of the working fluid in cooling engine.

It is a specific object of the invention to utilize magnetic forces to provide the desired controlling action of the free piston, gas-driven displacer.

It is a further object of the invention to utilize both magnetic retaining forces and magnetic snubbing forces to provide the desired controlling action for the free, gas-driven displacer.

It is a feature of the invention that the method can be practiced and the apparatus constructed utilizing relatively inexpensive and commercially available magnetic components.

BRIEF SUMMARY OF THE INVENTION

The present invention utilizes both magnetic retention and magnetic snubbing forces to control the movement of the displacer. A bi-directional magnetic "detent" is established at both the top dead center and bottom dead center positions of the displacer. The bi-directional magnetic detents each perform a two-fold function: first, the displacer is retained in the magnetic "detent" until a predetermined pressure differential across the drive piston is reached; and, secondly, the displacer is "snubbed" by the magnetic snubbing force of the magnetic detent as the displacer attempts to move beyond the detent position at top dead center and bottom dead center.

BRIEF DESCRIPTION OF THE DRAWINGS

The objects and features set forth above will best be understood from a detailed description of a preferred embodiment of the invention, selected for purposes of illustration, and shown in the accompanying drawings, in which.

DETAILED DESCRIPTION OF THE INVENTION

Figure 1:
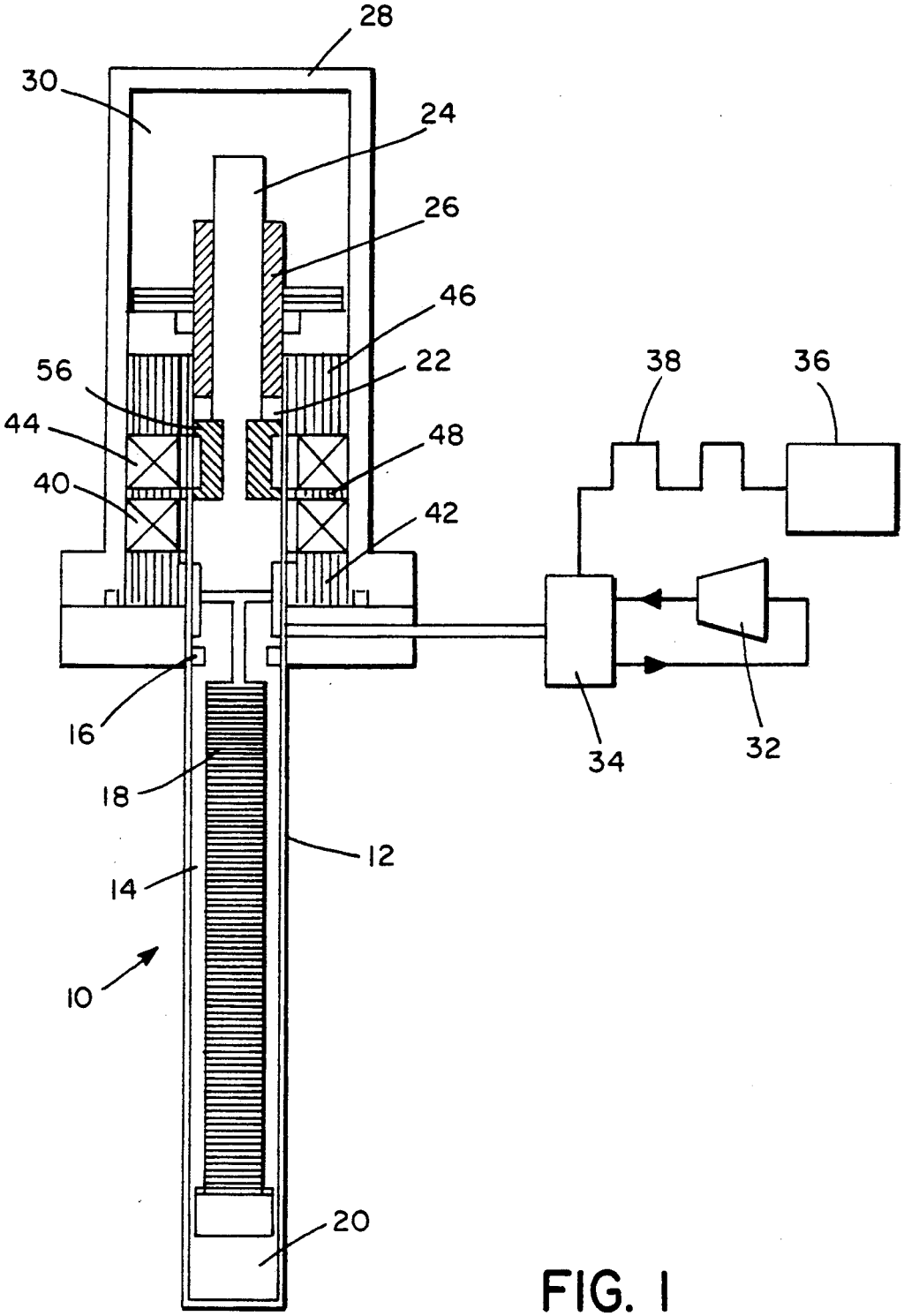
FIG. 1 is a diagrammatic view in side elevation showing a cooling engine having a free, gas-driven displacer and magnetic detents with the displacer shown in its upper position.

Turning now to the drawings, and particularly to FIG. 1 thereof, there is shown in diagrammatic form and side elevation a cooling engine indicated generally by the reference numeral 10. The cooling engine 10 has an expander cylinder 12 within which is located a free, gas-driven displacer 14, having a cylinder wall seal 16. A conventional screen regenerator I8 is located within the displacer to permit bi-directional fluid flow through the displacer. The lower end of cylinder 12 forms the "cold" volume 20 of the cooling engine while the upper end of cylinder 12 forms the "warm" volume 22.

The reciprocal movement of the displacer 14 in an up/down direction, as viewed in FIG. !, is controlled by the differential pressure across a drive piston 24 that is mechanically coupled to the displacer 14. The drive piston 24 slides within a drive cylinder 26 located within a housing 28 that defines a dead-ended drive volume 30 which is at intermediate pressure.

A fluid compressor 32 is fluidly coupled through a three-way valve 34 to the upper end of the displacer 14. A pulsing module 36 produces a square wave control signal 38 for the three-way valve 34. The three-way valve permits alternate pressurization and exhaust of the internal volumes of the displacer in a known manner.

In the embodiment shown in FIG. 1, two bi-directional magnetic "detents" are formed by a lower magnet 40, a lower pole piece 42, an upper magnet 44, an upper pole piece 46, an intermediate or center pole piece 48, and an iron core 48 mounted on the displacer drive piston 22. The polarity of magnets 40 and 44 are such that the pole pieces 42 and 46 have the same polarity with the center pole piece 48 of the opposite polarity. The iron core 50 has sufficient axial length to bridge the upper and center annular pole pieces 46 and 48 in one detent position, and the annular lower and center pole pieces 42 and 48 in the other detent position, as will be described in greater detail in connection with FIGS. 2–9.

Figure 2:
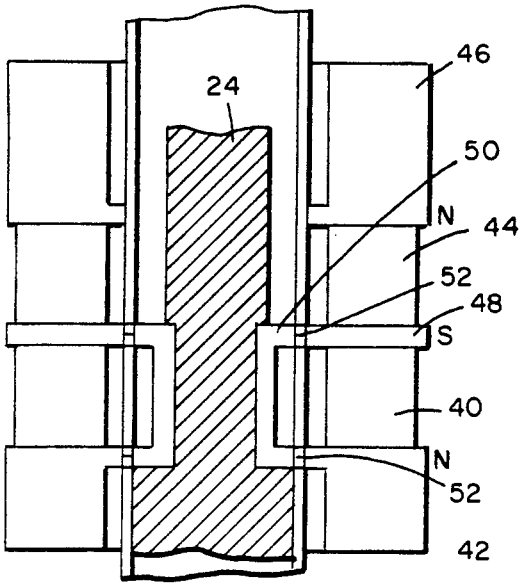
FIG. 2 is a view similar to that of FIG. 1 showing an enlarged form showing the magnetic components which form the magnetic detents with a zero differential pressure across the drive piston.
Figure 3:
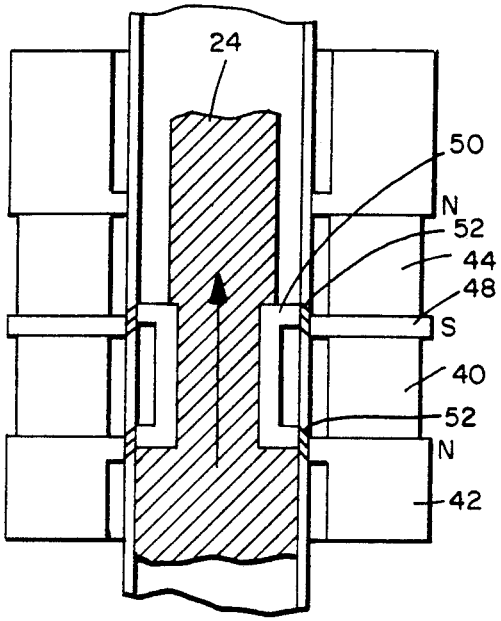
FIG. 3 is a view similar to that of FIG. 2 showing the stretching of the magnetic lines of flux as the piston starts to move in an upwardly direction as viewed in FIG. 3.
Figure 4:
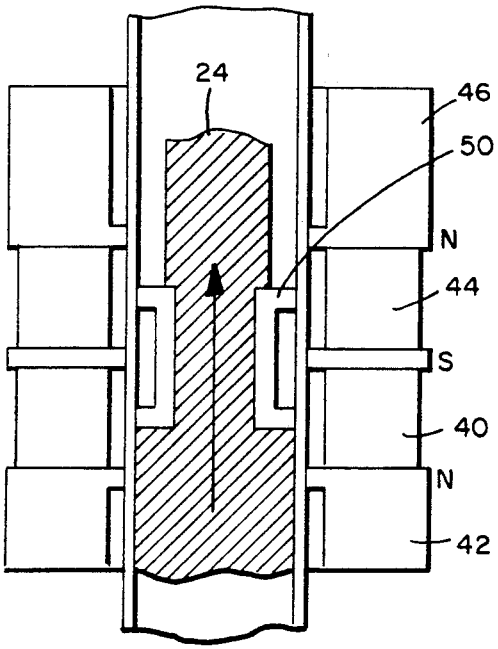
FIG. 4 is a view similar to that of FIG. 3 showing the piston after it has broken away from the magnetic retaining force depicted in FIG. 3.

Referring now to FIGS. 2–9, there is shown an enlarged form the magnetic components that define the two bi-directional magnetic "detents" and illustrate the sequence of operations. In FIG. 2, the magnetic lines of flux 52 extend from the lower and center pole pieces 42 and 48, respectively, directly into the iron core 50. This position represents one of the two so-called magnetic "detents". In this detent position, there is a zero differential pressure across the drive piston 24. As the differential pressure increases across the drive piston, the magnetic lines of flux 52 are stretched in the vertical direction as shown in FIG. 3. The magnetic retaining force generated by the lower magnet and iron core prevents the piston from breaking free of the magnetic couple until a predetermined pressure differential has been established across the piston. Once this pressure differential has been reached, the piston is free to break away and move in the upwardly direction as shown in FIG. 4. When the piston and iron core reaches the position shown in FIG. 5, it has entered the second bi-directional magnetic detent position with the magnetic lines of flux 52 extending between the iron core 50 and the upper and center pole pieces 46 and 48, respectively.

Figure 5:
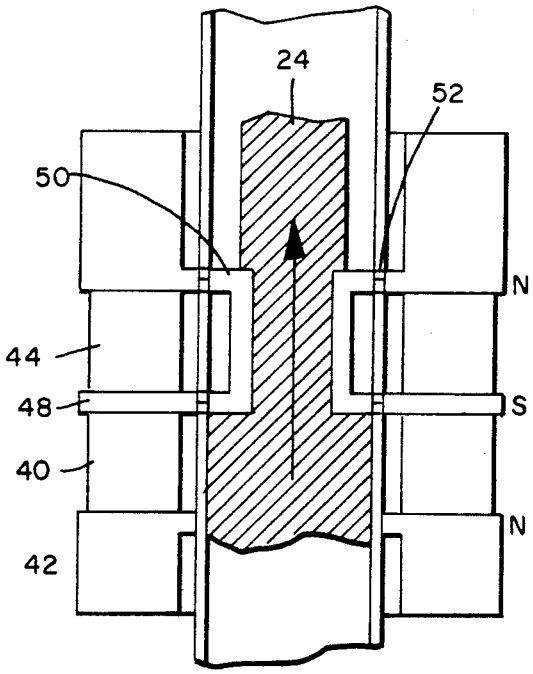
FIG. 5 is a view similar to that of FIG. 4 showing the piston at the upper magnetic detent position.
Figure 6:
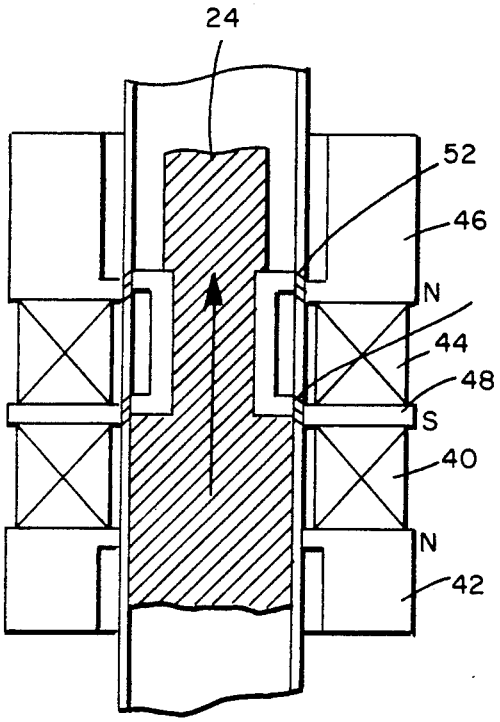
FIG. 6 is a view similar to that of FIG. 5 showing the snubbing action of the lines of magnetic flux between the upper magnet and core attached to the piston.
Figure 7:
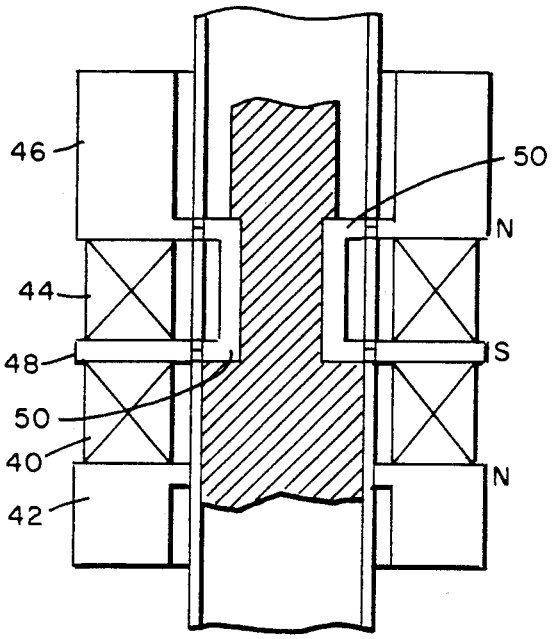
FIG. 7 is a view similar to that of FIG. 6 showing the piston and core in the upper magnetic detent position.
Figure 8:
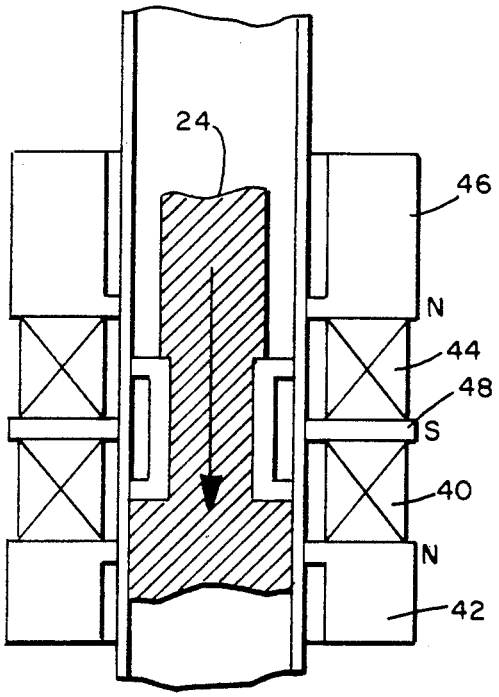
FIG. 8 is a view similar to that of FIG. 7 showing the piston and core breaking away from the upper magnetic detent position.
Figure 9:
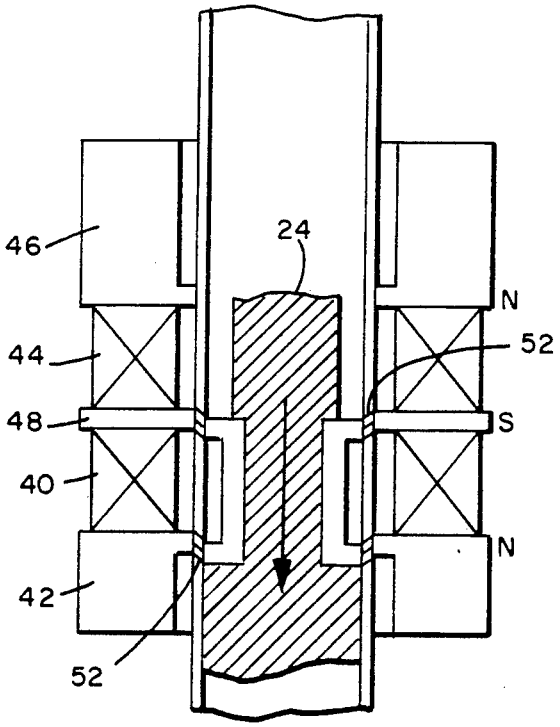
FIG. 9 is a view similar to that of FIG. 8 showing the snubbing action by the magnetic lines of flux between the lower magnet and core.

Further upward movement of the piston, as viewed in FIGS. 5 and 6, is snubbed by the stretching of the magnetic lines of flux 52 in the vertical direction, as shown in FIG. 6. The piston is held in the second magnetic detent as shown in FIG. 7. This figure depicts the second zero differential pressure condition. FIGS. 8 and 9 depict the sequence of breaking away from the upper or second magnetic bi-directional detent position shown in FIG. 7 with FIG. 9 illustrating the snubbing action in the opposite direction.

FIGS. 10–17 illustrate another embodiment of the invention, which utilizes a single magnet 54 with upper and lower pole pieces 56 and 58, respectively. The iron core 50 has two reduced diameter portions 50A and 50B which define an intermediate portion 50C and two end portions 50D and 50E.

Figure 10:
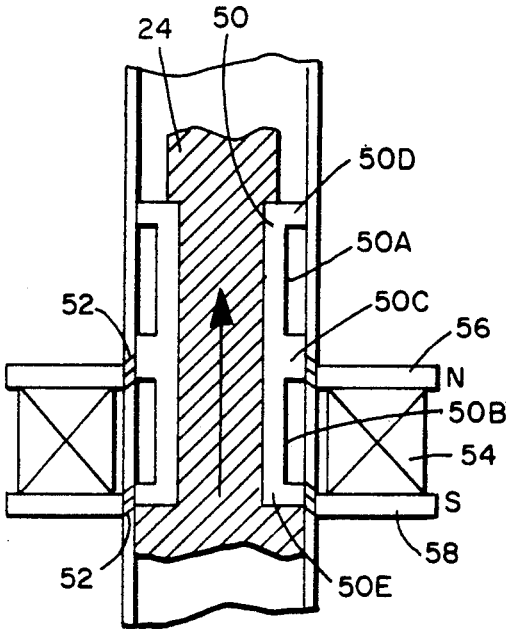
FIGS. 10–17 show another embodiment of the invention in the same sequence of operations as that depicted in FIGS. 2–9; and, FIG. 18 depicts in diagrammatic form another embodiment which utilizes rotary as opposed to axial motion to define the two bi-directional magnetic detents.
Figure 11:
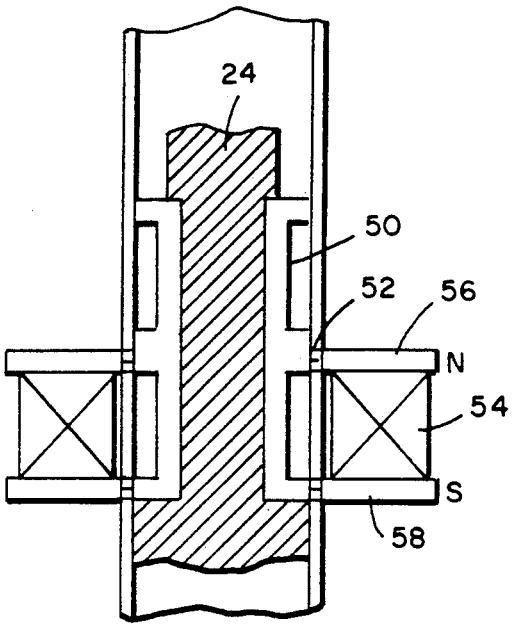

FIG. 10 illustrates the snubbing action as the displacer and piston moves in an upwardly direction as viewed in FIG. 10. The magnetic lines of flux 52 are stretched in the vertical direction between the upper pole piece 56 and the intermediate portion 50C of the iron core and between the lower pole piece 58 and the iron core end portion 50E. The total snubbing force is the sum of both of these magnetic forces. The magnetic snubbing force returns the piston and core to the first bi-directional magnetic detent position, shown in FIG. 11. In this position, there is a zero differential pressure across the drive piston 24.

Figure 12:
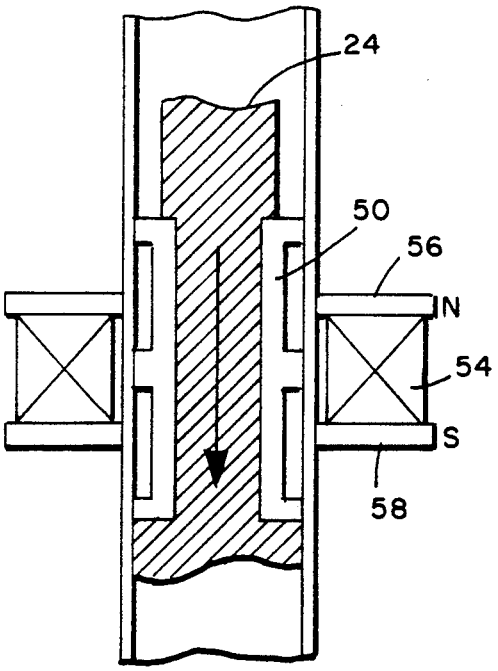

FIG. 12 shows the breakaway action of the drive piston and displacer after a predetermined differential pressure has been reached across the drive piston.

Figure 13:
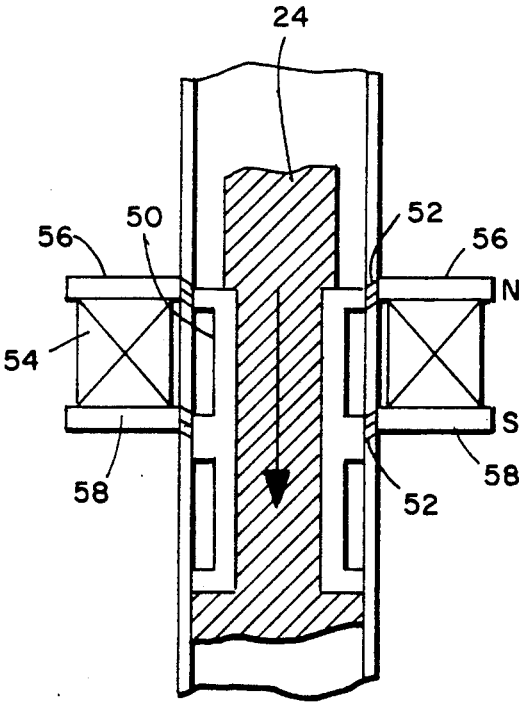

FIG. 13 illustrates the magnetic snubbing force action in the second bi-directional magnetic detent position, as illustrated by the stretched lines of magnetic flux 52 in the vertical direction. In this snubbing position, the magnetic lines of flux 52 are stretched vertically between the upper pole piece 56 and the end portion 50D of the core and between the lower pile piece 58 and the intermediate portion 50C of the core.

Figure 14:
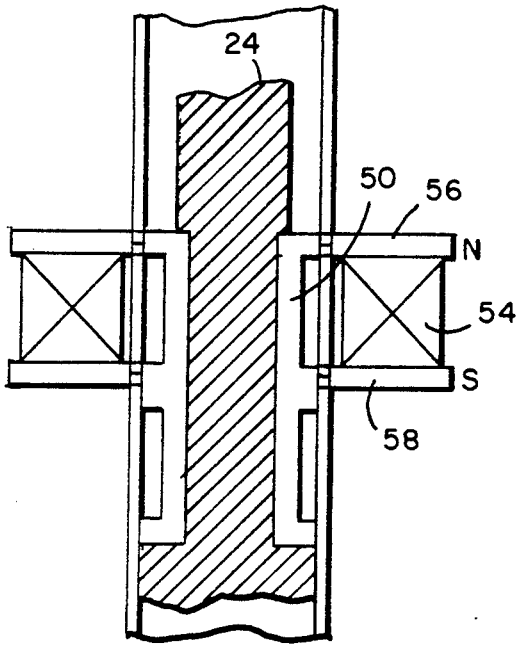

FIG. 14 illustrates the position of the drive piston, iron core and single magnet at the zero differential pressure condition across the drive piston 24.

Figure 15:
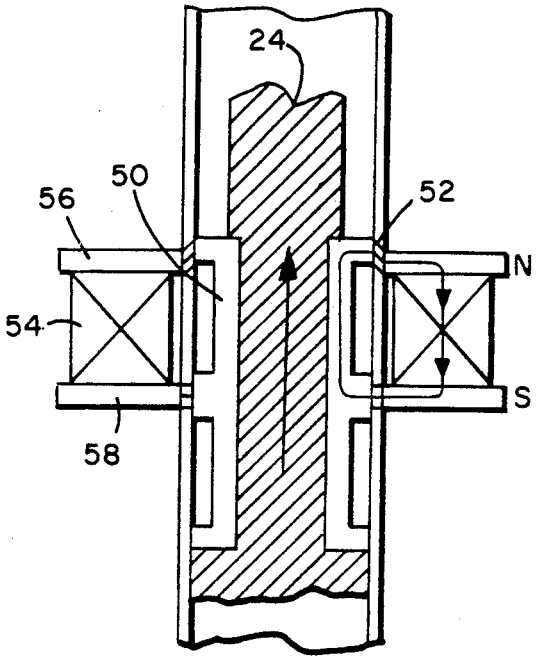

FIG. 15 depicts the magnetic retention force, which prevents the piston and displacer from moving significantly away from the detent position until a predetermined pressure differential is established across the drive piston. In this retention position, the magnetic lines of flux 52 are stretched vertically between the upper pole piece 56 and the end portion 50D of the iron core.

Figure 16:
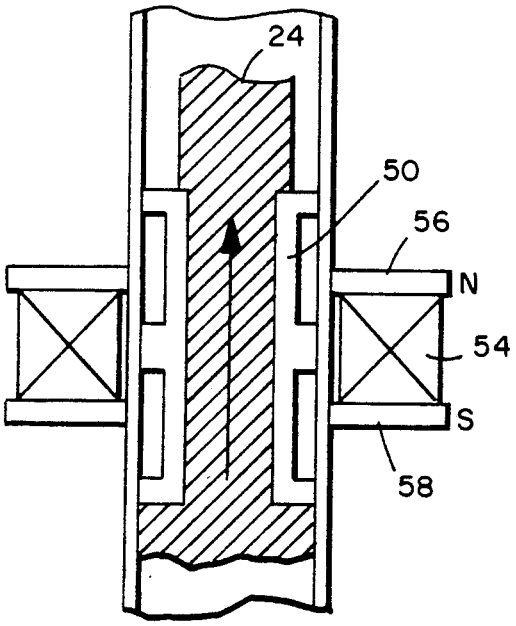
Figure 17:
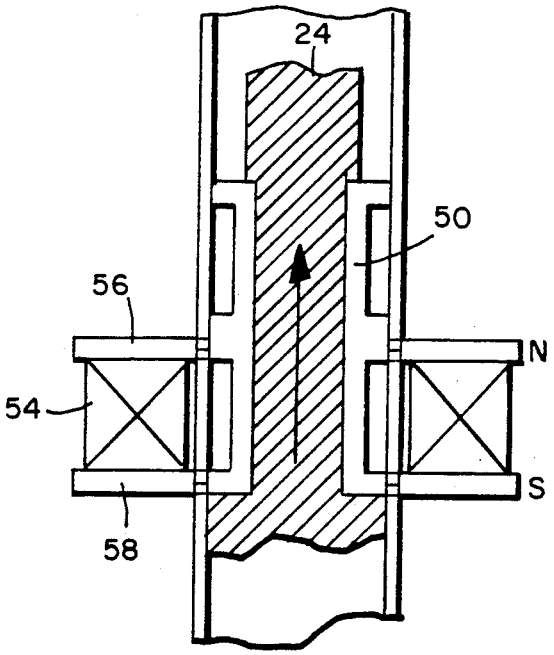

FIG. 16 illustrates the breakaway condition after the predetermined pressure differential has been reached. Finally FIG. 17 depicts the first magnetic detent position with the sequence continuing with the snubbing action depicted in FIG. 10.

It should be noted that the magnitudes of the snubbing forces and retention forces can be varied by controlling the axial length of the intermediate portion 50C of the iron core or by controlling the axial length of the pole pieces 56 or 58. In the embodiment shown in FIGS. 10–17, the intermediate portion 50C has a longer axial length than the end portions 50D and 50E. This configuration produces a greater snubbing force than the retention force in either direction.

By using different magnitudes for the snubbing and retaining forces, one can compensate for differing gas densities as a function of temperature, depending upon the direction of movement of the displacer from the cold to hot end and vice versa. Similarly, the magnitudes of the snubbing forces themselves can be varied, as can be the retention forces, depending upon the direction of movement of the displacer.

Figure 18:
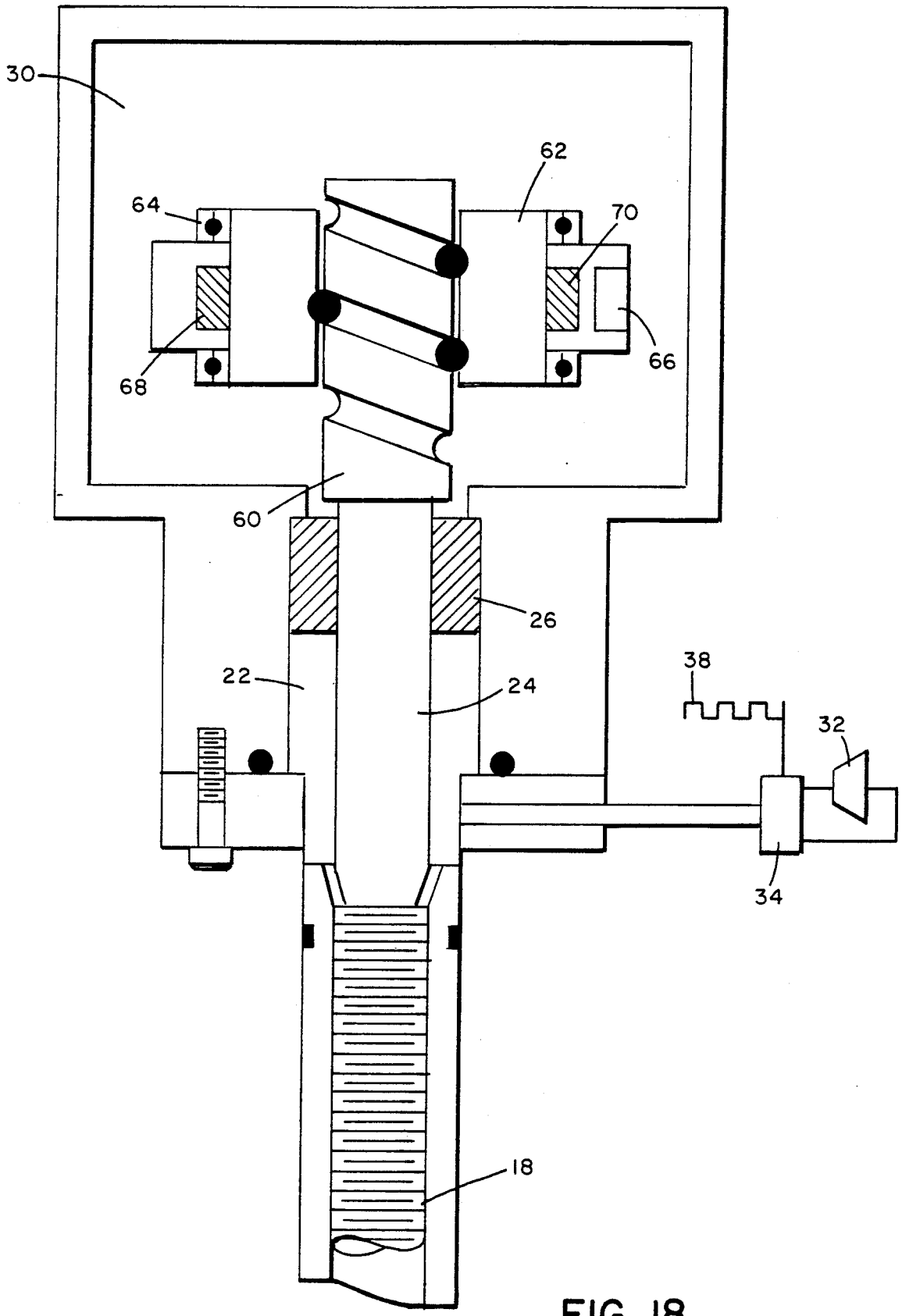

Referring to FIG. 18, there is shown in diagrammatic form another embodiment of the invention which utilizes rotary motion as opposed to axial motion to define the two bi-directional magnetic detents. The drive piston 24 incorporates a stationary ball screw 60, upon which is mounted a rotating ball nut 62 with ball bearings 64. A single magnet 66 and two iron cores 68 and 70 attach to the rotating ball nut 62 cooperate to define the two bi-directional magnetic detents.

It will be appreciated that the magnets can be either permanent or electro-magnets or a combination thereof. The use of electromagnets permits the control of the magnitude of the snubbing and retaining of forces as a function of the current flow through the electro-magnet.

Having described in detail a preferred embodiment of the invention, it will now be apparent to those skilled in the art that numerous modifications can be made therein without departing from the scope of the invention, as defined in the following claims.

What we claim and desire to secure by Letters Patent of the United States is:

1. A method for controlling the movement of a free motion, gas-driven, piston actuated displacer with respect to the top dead center and bottom dead center portions of its cycle and the pressure across the displacer's actuation piston in a cooling engine, said method comprising the steps of:

(1) generating a magnetic snubbing force that acts on the displacer to limit the movement of the displacer beyond top dead center;

(2) generating another magnetic snubbing force that acts on the displacer to limit the movement of the displacer beyond bottom dead center;

(3) generating a magnetic retaining force that acts on the displacer to prevent the displacer from moving towards bottom dead center until a first predetermined pressure differential as established across the displacer's actuation piston; and, (4) generating a magnetic retaining force that acts on the displacer to prevent the displacer from moving towards top dead center until a second predetermined pressure differential is established across the displacer's actuation piston.

2. The method of claim 1 wherein said magnetic snubbing forces are of equal magnitude.

3. The method of claim 1 wherein said magnetic snubbing forces are unequal magnitude.

4. The method of claim 1 wherein said magnetic retaining forces are of equal magnitude.

5. The method of claim 1 wherein said magnetic retaining forces are of unequal magnitude.

6. The method of claim 1 wherein said magnetic snubbing forces and said magnetic retaining forces are of equal magnitude.

7. The method of claim 1 wherein said magnetic snubbing forces and said magnetic retaining forces are of unequal magnitude.

8. The method of claim 7 wherein the magnitudes of the magnetic snubbing forces are greater than the magnitudes of the magnetic retaining forces.

9. The method of claim 1 wherein the magnitude of at least one of the magnetic snubbing forces is greater than the magnitude of at least one of the magnetic retention forces.

10. In a cooling engine having a free, gas-driven displacer and drive piston, the improvement comprising:

A. means defining a first bi-directional magnetic detent, said first magnetic detent generating:

(i) a first magnetic snubbing force that acts on the displacer as the displacer moves beyond top dead center; and, (ii) a first magnetic retaining force that acts on the displacer to prevent the displacer from moving towards bottom dead center until a predetermined pressure differential is established across the displacer's drive piston;

B. means defining a second bi-directional magnetic detent, said second magnetic detent generating:

(i) a second magnetic snubbing force that acts on the displacer as the displacer moves beyond bottom dead center; and, (ii) a second magnetic break-away retaining force that acts on the displacer to prevent the displacer from moving towards top dead center until a predetermined pressure differential is established across the displacer's drive piston.

11. The cooling engine of claim 10 wherein said first bi-directional magnetic detent means includes a first magnet and a movable magnetic core means that defines a first magnetic flux path with respect to said first magnet and wherein said second bi-directional magnetic detent means includes a second magnet and said movable magnetic core means which defines a second magnetic flux path with respect to said second magnet when the magnetic core means moves from one magnet to the other magnet, said magnetic core means being mechanically coupled to the displacer for movement therewith.

12. The cooling engine of claim 10 wherein said first and second bi-directional magnetic detent means comprise a magnet and a movable magnetic core means that defines first and second magnetic flux paths with the poles of said magnet as the magnetic core means moves with respect to said magnetic poles, said first and second magnetic flux paths having a common portion, and said magnetic core means being mechanically coupled to the displacer for movement therewith.

13. In a cooling engine having a free, gas-driven displacer and drive piston, the improvement comprising:

(1) means for generating a first magnetic snubbing force that acts on the displacer as the displacer moves beyond top dead center;

(2) means for generating a second magnetic snubbing force that acts on the displacer as the displacer moves beyond bottom dead center;

(3) means for generating a first magnetic retaining force that acts on the displacer to prevent the displacer from moving towards bottom dead center until a predetermined pressure differential is established across the displacer's drive piston; and, (4) means for generating a second magnetic retaining force that acts on the displacer to prevent the displacer from moving towards top dead center until a predetermined pressure differential is established across the displacer's drive piston.

14. The cooling engine of claim 13 wherein said first magnetic snubbing force generating means generates a magnetic snubbing force that is equal to, less than, or greater than the magnetic snubbing force generated by said second magnetic snubbing force generating means.

15. The cooling engine of claim 13 wherein said first magnetic snubbing force generating means generates a magnetic snubbing force that is greater than the first magnetic retaining force generated by said first magnetic retaining force generating means.

16. The cooling engine of claim 13 wherein said second magnetic snubbing force generating means generates said magnetic snubbing face that is greater than the second magnetic retaining force generated by said second magnetic retaining force generating means.

17. The cooling engine of claim 13 wherein said first magnetic retaining force generating means generates a retaining force that is equal to, less than, or greater than the magnetic retaining force generated by said second magnetic retaining force generating means.

18. In a cooling engine having a free, gas-driven displacer and drive piston, the improvement comprising:

A bi-directional magnetic detent means comprising:

(i) A first ring shaped magnet means (ii) A second ring shaped magnet means, said first and second ring shaped magnet means being positioned in axial alignment (iii) A generally cylindrical magnetic flux conducting core means positioned for axial movement between s id two ring shaped magnet means to establish corresponding first and second magnetic flux paths therewith, said core means being mechanically coupled to the displacer for movement therewith.

19. In a cooling engine having a free, gas-driven displacer and drive piston, the improvement comprising:

A bi-directional magnetic detent means comprising:

(i) A ring shaped magnet;

(ii) A generally cylinder magnetic flux conducting core means positioned for axial movement between the poles of said ring shaped magnet to establish corresponding first and second magnetic flux paths therewith, said first and second magnetic flux paths having a common portion, and said core means being mechanically coupled to the displacer for movement therewith.

20. The cooling engine of claim 19 wherein the generally cylindrical magnetic flux conducting core means of the first bi-directional magnetic detent means has two axially spaced, reduced diameter segments that define an intermediate portion and two end portions.

21. The cooling engine of claim 20 wherein the axial length of the intermediate portion is greater than the axial length of at least one of the two end portions.

22. The cooling engine of claim 20 wherein the axial length of the intermediate portion is greater than the axial length of both end portions.

23. The cooling engine of claim 20 wherein the axial length of one end portion is different from the axial length of the other end portion.

* * * * *